US007188457B1

(12) United States Patent
Halama

(10) Patent No.: US 7,188,457 B1
(45) Date of Patent: Mar. 13, 2007

(54) HOLLOW POST ANCHORING BRACKETS

(76) Inventor: Kenneth J. Halama, 36164 Walnut, Independence, WI (US) 54747

( * ) Notice: Subject to any disclaimer, the term of this patent is extended or adjusted under 35 U.S.C. 154(b) by 442 days.

(21) Appl. No.: 10/754,744

(22) Filed: Jan. 8, 2004

(51) Int. Cl.
*E04B 1/38* (2006.01)

(52) U.S. Cl. ..... 52/698; 52/745.17; 256/65.14; 403/314; 248/501; 248/511

(58) Field of Classification Search ..... 52/169.1, 52/169.13, 296, 170, 297, 298, 745.17, 745.21, 52/698; 403/300, 308, 314; 248/501, 503, 248/188, 188.1, 346.01; 411/34, 44, 55, 411/57.1, 60.2, 385
See application file for complete search history.

(56) References Cited

U.S. PATENT DOCUMENTS 2,218,581 A * 10/1940 Levan ..... 220/243
2,972,495 A * 2/1961 Yalen ..... 403/176
4,819,916 A * 4/1989 Wun-chung ..... 256/13.1
5,186,549 A 2/1993 Walters et al.
5,359,827 A * 11/1994 Gehman ..... 52/698
6,206,200 B1 3/2001 Gilles et al.
6,209,267 B1 4/2001 Dantzer
6,216,844 B1 4/2001 Simonis

* cited by examiner

*Primary Examiner*—Naoko Slack
*Assistant Examiner*—William Gilbert
(74) *Attorney, Agent, or Firm*—M. Paul Hendrickson

(57) ABSTRACT

The present invention provides a hollow post anchoring device. The anchoring device includes a mounting plate for mounting onto a base and equipped with upwardly extending legs designed to mate onto the internal cornered recession of the hollow post. The legs include inwardly bent indentations which when biased outwardly with a biasing plate will wedge the legs firmly against the cornered recesses and anchor the hollow post onto a suitable base, such as a porch.

14 Claims, 4 Drawing Sheets

HOLLOW POST ANCHORING BRACKETS

FIELD OF THE INVENTION

The present invention relates to mounting devices and more particularly to a post anchoring bracket for anchoring hollow posts to a supportive base and the method for using the same.

BACKGROUND OF THE INVENTION

There exists a need for a post anchoring bracket which would permit a hollow post such as a decorative post to be securely anchored to a supportive base without defacing the post decor. It accordingly would be particularly desirable if there were an anchoring means for firmly mounting and anchoring various shaped articles, such as columns, posts, railing supports to a solid base such as a patio, porch or overhang etc. U.S. Pat. No. 6,216,844 to Simonis discloses a mounting system for assembling components comprising a reduced structural height of a conveyor system and a simplified construction of a mounting system. It has a base plate which rests upon the conveyor system and at least one column extending vertically away from the base plate and a supporting element releasably connected to at least one column for receiving components and a plurality of mounting stations for receiving the components transported on the workpiece carrier. U.S. Pat. No. 5,186,549 to Walters, et al discloses a furniture piece of the glider-type such as a porch chair comprising a stationery frame member providing a support for a movable carriage member of the type for mounting a seat upon a frame member having two horizontally extending support members. In U.S. Pat. No. 6,206,200 B1 to Gilles, et al there is disclosed a modular screen panel mounting system which allows screen panels to be replaced more quickly. U.S. Pat. No. 6,209,267 to Dantzer discloses a modular decking system, in which most of the elements of the system are precut and pre-assembled.

SUMMARY OF THE INVENTION

The present invention provides an anchoring and mounting device for hollow posts such as decorative posts and columns fabricated from plastics such as vinyl. The anchoring device includes a mounting plate with vertically extending legs preferably positioned in the configuration of the corners of the internal chamber for the post to be mounted. There is typically provided one leg for each internal corner of any hollowed polygonally shaped post. In the case of a rectangular shaped post, there may be appropriately provided four vertical extending legs positioned in each one of the chambered corners of the hollow rectangular shaped post. In the event there should be 3, 5, 6, etc., corners within the hollows post, there would accordingly be preferably provided a corresponding number of vertical legs positioned so as to fit snugly against each of the hollow post corners. The vertical legs are spaced sufficiently apart so as to allow each hollow post to snugly slide over the interfacing vertical legs. The vertical legs are designed to be tightly drawn against the mating corners when biased outwardly by a biasing means.

The hollow post mounting and anchoring device serves as a post anchor for anchoring a hollow post to a supportive base with the anchoring device (serves as a bracket) being equipped with upwardly extending legs positionally configured and supported by the mounting plate so as to preferably interfacially engage onto the corners of the internal walls of the hollow chamber of the post. Each of the upwardly extending legs is provided with an upper inwardly projecting indented surface laterally disposed so as to vertically mate onto an adjacently corresponding upper inwardly projecting indented surface of an adjacently positioned leg and preferably further equipped with a lower inwardly extending indented surface positioned beneath the upper cammed surface and correspondingly aligned so as to laterally mate onto a corresponding lower inwardly extending indented surface of each adjacently positioned leg. Through the use of an upper biasing plate for slidably engaging onto the upper indented surface for each of the legs and a lower biasing plate for slidably engaging onto the lower indented surface for each of the legs, the upper and lower biasing members when drawn tightly together exert an outwardly biasing force so as to cause the legs to move outwardly and wedge onto the corners of the internal walls of the hollow posts and thereby firmly anchor the hollow post to the hollow post anchoring device and the supportive base.

DETAILED DESCRIPTION OF THE INVENTION

Figure 1:
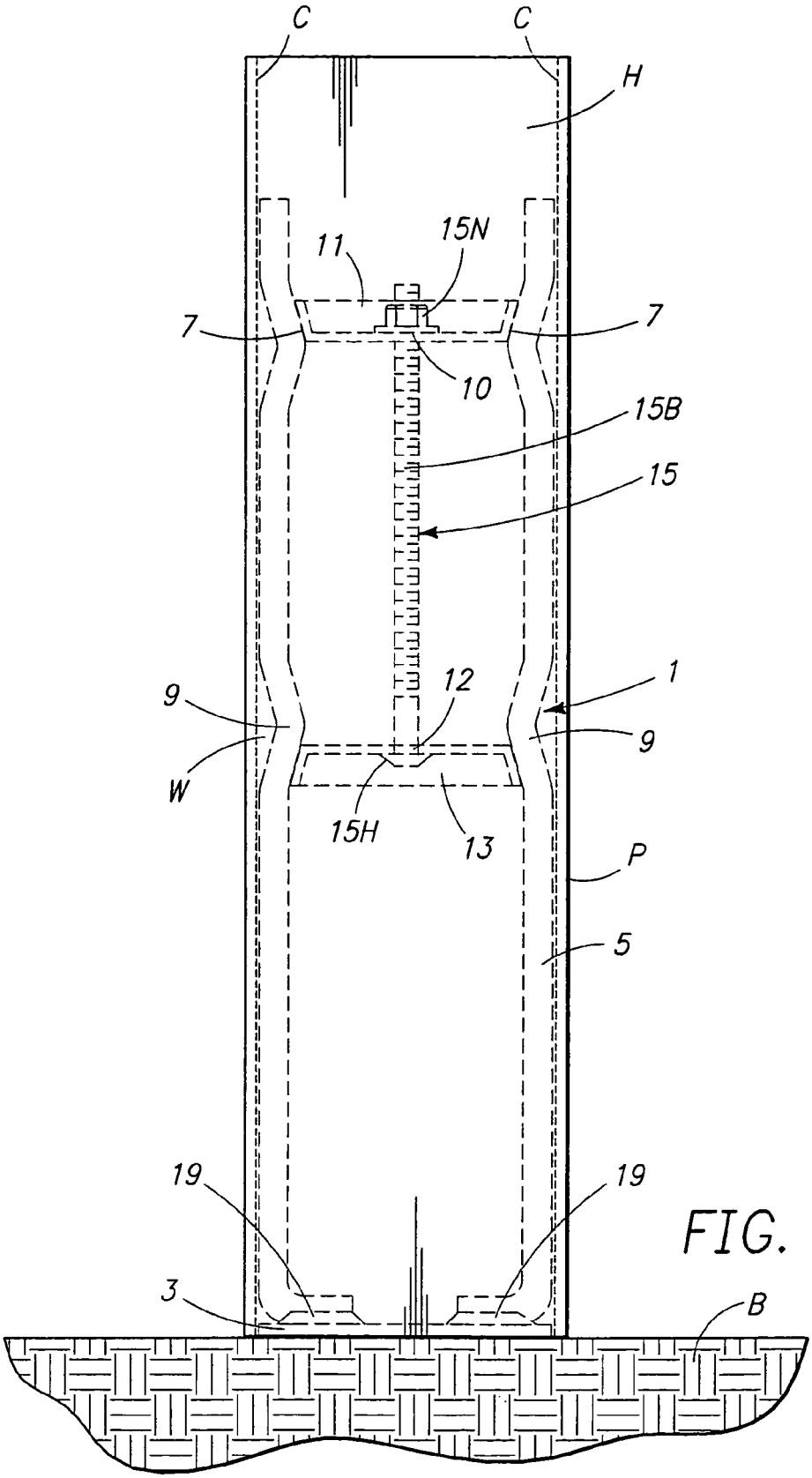
FIG. 1 is a cross-sectional view of a hollow post anchored to a supportive base with the hollow post anchoring device of this invention.
Figure 2:
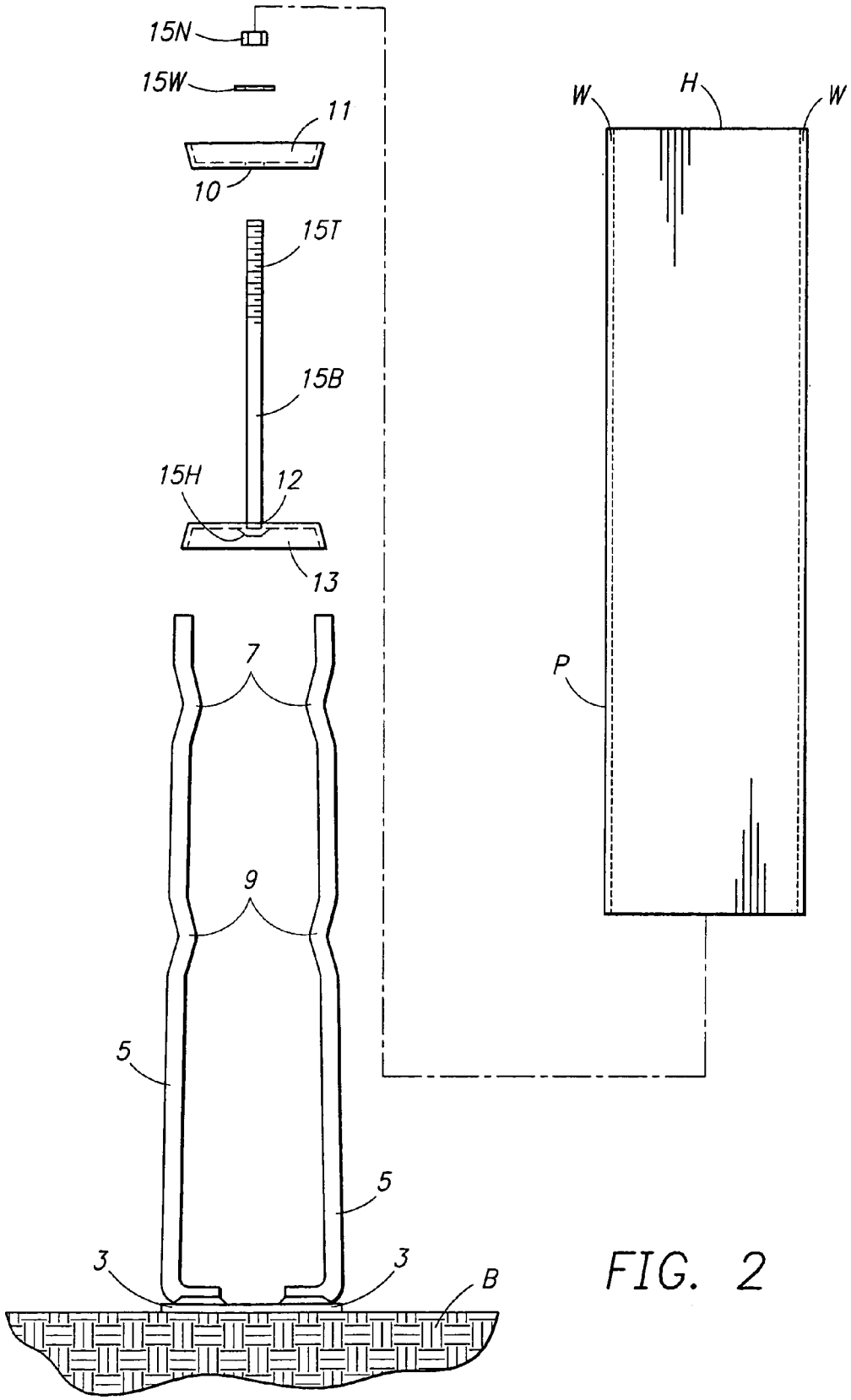
FIG. 2 is an exploded side view of the hollow post anchoring device shown in FIG. 1

With references to the preferred embodiments of the invention as shown in FIGS. 1–4 and 6–7, there is provided a post anchoring device 1 for anchoring a hollow post P having internal walls W defining a hollow internal chamber H to a supportive base B, said post anchoring device 1 comprising a mounting plate 3 for mounting the post anchoring device 1 to the supportive base B, upwardly extending legs 5 positionally configured and mounted to said mounting plate 3 so as to interfacially engage onto the internal walls W (preferably the cornered sections C) of said hollow internal chamber H with each of said legs 5 having an inwardly projecting upper indented section 7 laterally disposed so as to vertically mate onto a corresponding inwardly projecting upper indented surface 7 of an adjacently positioned leg 5 and an inwardly projecting lower indented section 9 positioned beneath the upper indented section 7 and correspondingly aligned so as to laterally mate onto a corresponding inwardly projecting lower cammed section 9 of adjacently positioned legs 5, an upper biasing plate 11 for slidably engaging onto the upper cammed section 7 of each of said legs 5, a lower biasing plate 13 for slidably engaging onto the lower cammed section 9 of each of said legs 5, and a biasing member (generally designated as 15) for slidably drawing together said upper biasing plate 11 and said lower biasing plate 13 onto said upper indented section 7 and said lower indented section 9 of each of said legs 5 so as to thereby cause legs 5 to move biasingly outwardly and thereby firmly bias and wedge legs 5 onto the cornered section C of internal walls W and permit the hollow post P to thereby be firmly anchored to said post anchoring bracket 1.

Figure 5:
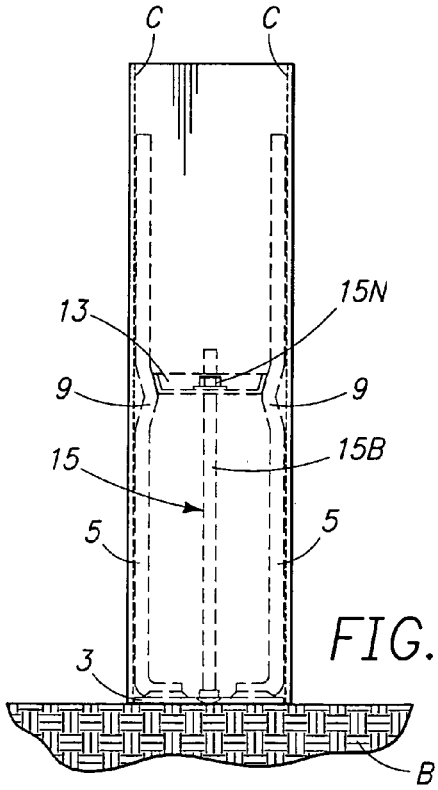
FIG. 5 is a cross-sectional view depicting another embodiment of an anchoring post device of this invention.
Figure 6:
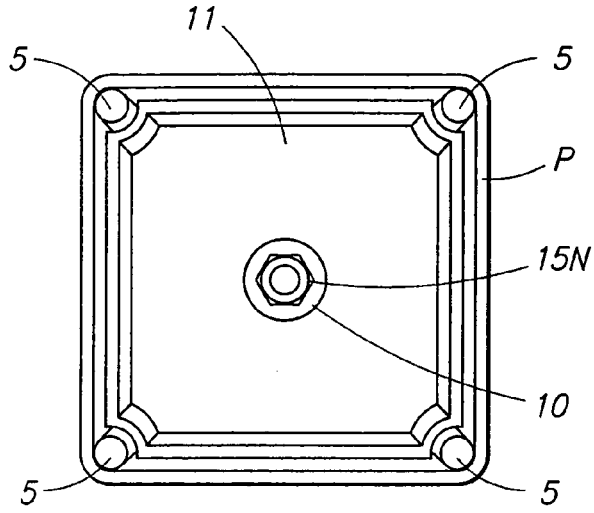
FIG. 6 is a top view of the hollow post anchoring device of FIG. 1 revealing the upwardly projecting legs firmly biased onto the hollowed corners of the hollow post.
Figure 7:
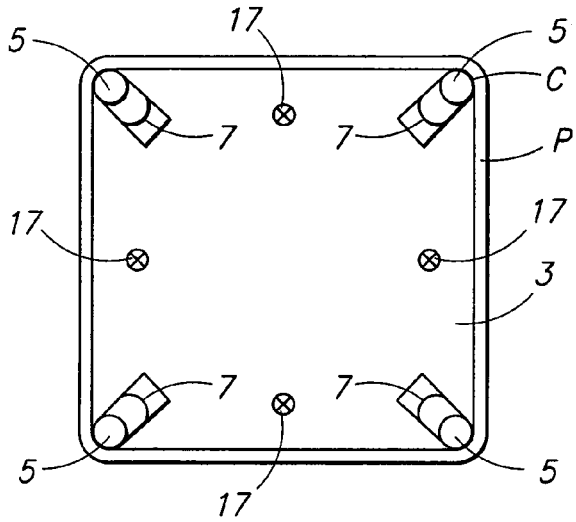
FIG. 7 is a top view of the mounting plate for anchoring the hollow post anchoring device of FIG. 1 to a supportive base.

FIG. 1 depicts a bisectional side view of a square post P having an internal wall W having four corners C of which only two are shown with the biasing legs 5 (welded at weld 19) being firmly wedged into the four mating corners C as further shown in FIG. 6. The anchoring or mounting plate 3 is securely anchored onto the supportive base B by an anchoring screws or bolts 17 and legs 5 may be welded to the mounting plate 3 as shown in FIGS. 1–5 and 7–8, so as to maintain legs 5 in a rigid upwardly extending position. A threaded bolt 15B with bolt head 15H welded or otherwise secured passing through bottom plate aperture 12 and an upper plate aperture 10 and nutted with tightening nut 15N threaded onto threaded bolt 15B serves as biasing member 15. When tightening, nut 15N is threaded onto bolt threads 15B whereupon the lower 13 and upper 11 biasing plates are drawn together which turn cause the upper and lower cammed sections (7 & 9) to bias and wedge legs 5 firmly outwardly onto the internal corner C of the hollow post P and thus firmly anchor the post P to the anchoring post bracket 1 and supportive base B as partially illustrated by FIGS. 1, 3, 4 and 6.

Figure 3:
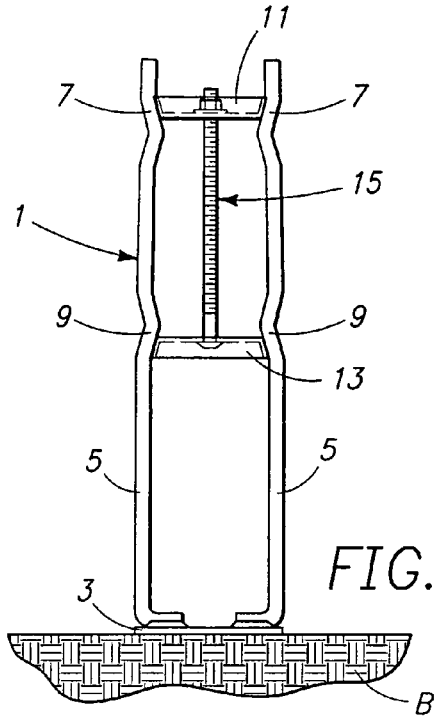
FIG. 3 is a side view of the device shown in FIG. 2 mounted to a supportive base and in a position to receive a hollow post.

In the preferred embodiment of the invention the hollow post anchoring device 1 is provided in preassembled form for anchoring onto a supportive base B as illustrated by FIG. 3. The method of using the post anchoring device 1 involves anchoring the device 1 to a supportive base such as a wood, concrete floor or other suitable anchoring base (B), inserting the hollow post P over the post anchoring device 1 and then tightening nut 15N so as to wedge legs 5 tightly against the post corners (c) as shown in FIGS. 1 and 6.

Figure 4:
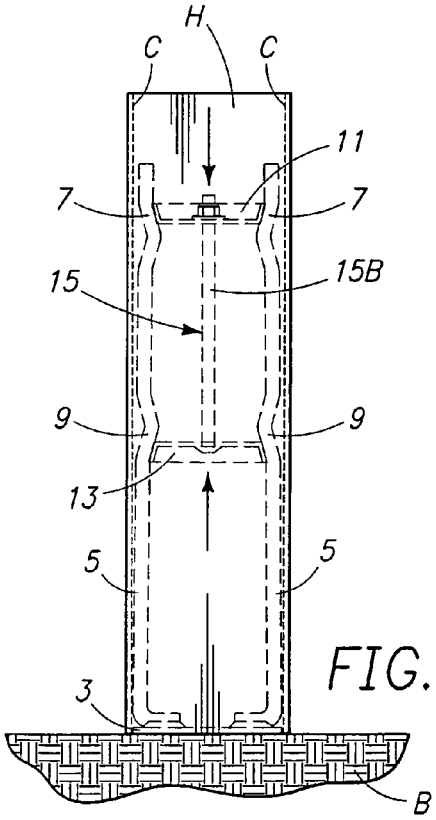
FIG. 4 is a cross-sectional view of the hollow post anchoring device of FIG. 3 showing the upper biasing plate and lower biasing plate positioned in an unbiasing position with a threaded bolt and a nut positioned so as to permit a biasing of the biasing plates together and anchor the hollow post thereto as shown in FIG. 1.

The cross-sectional views of FIGS. 3 and 4 illustrate the sequential steps in the preferred embodiment of the invention securing a hollow post P the post anchoring device 1 of this invention. More specifically, there is provided in the preferred embodiments of the invention a method for mounting a hollow post P having internal walls W defining an internal hollow chamber H onto a supportive base B with a post anchoring device 1 having a mounting plate 3 fitted with vertically extending legs 5 for mounting to a supportive base B of a predetermined spacial configuration so as to interfacial engage onto the internal walls W of said hollow post P (preferably in the case of a cornered post P into the internal corners C), with each of said legs 5 respectively having an upper inwardly extending indentation 7 and a lower inwardly extending indentation 9 in corresponding vertical alignment with one another, a lower biasing plate 13 for engagement beneath the lower inwardly extending indentation 9 of each of said legs 5, a upper biasing plate 11 for engaging above the upper inwardly extending indentation 7 of each leg 5 and a biasing member 15 for drawing the upper biasing plate 11 and lower biasing plate 13 together so as to outwardly force and thereby bias and wedge the upper outwardly extending indentation 7 and the lower outwardly extending indentation 9 of each of said legs onto the internal walls W or corners C of said hollow post P, said method comprising:

a) anchoring the mounting plate 3 of the hollow post anchoring device 1 to a supportive base B with the biasing member being positioned in an undrawn or unbiased position as illustrated in FIGS. 3 and 4, b) placing the internal walls W and preferably the internal corners C of the hollow post P in an interfacing relationship with said vertical extending legs 5 as particularly illustrated by FIG. 6, and c) drawing the upper biasing plate 11 and the lower biasing plate 13 together with said biasing member 15 by tightening nut 15N onto bolt thread 15B so as to force the upper indentation 7 and the lower indentation 9 of each leg 5 outwardly to biasingly wedge said legs 5 onto the corners C of said internal walls W and thereby firmly mount and anchor said hollow post P to said supportive base B with said post anchoring device 1.

It is not necessary to use the post anchoring device 1 in a manner in which legs 5 are in juxtaposition to a corner of the hollow post. In columns or posts without corners such as circular columns or posts, at least two and preferably three or more legs 5 are utilized to firmly wedge legs 5 against the inner circular surface W of the column or posts. For most applications, the anchoring device 1 will include a plurality of legs 5 and preferably three (3) or more legs.

The hollow post anchoring device 1 is preferably of a metal construction. The anchoring plate 3, the upper biasing plate 11 and lower biasing plate 13 may be for example of a 10 gauge plate metal of a size sufficient to cover the interior dimensions of the internal chamber C of the hollow post P. As may be observed from the figures, the upper 11 and lower 13 biasing plates are flanged outwardly about their outer peripheral margin so as to effectively wedge the indentations 9 outwardly when a drawing biasing force is applied against the upper 11 and lower 13 biasing plates by threaded bolt 15B. A 7/16 inch diameter steel rod stock with the indentations having an inwardly bend of about ¼ inch to about ½ inch will adequately serve to firmly bias the legs 5 against the hollow post corners C. A threaded rod 15B (e.g. ⅜–16 thread) welded or otherwise secured to a lower biasing site may effectively serve as a biasing member 15.

A typical hollow post anchoring device 1 may measure about 17.625 inches in height with the lower indentations 9 being positioned at 8.562 inches from the base and the upper indentations 7 being spaced about 7 1.2 inches above the lower indentations 9.

Figure 8:
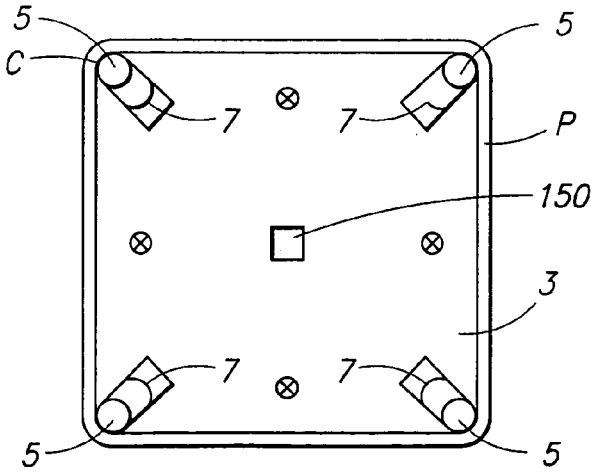
FIG. 8 is a top view of the mounting plate used to anchor the hollow post anchoring device of FIG. 5 to a supportive base.

The alternative embodiment of the invention as illustrated by FIGS. 5 and 8 involves only one set of indentations 9 and a single biasing plate 13 biased onto the indentations 9 by threaded carriage bolt 15B, the head 15H of which is seated onto the head bolt receiving aperture 150 of mounting plate 3. By simply tightening the biasing nut 15N onto carriage bolt threads 15B, biasing plate 13 is drawn firmly against knees 7 thus wedging legs 5 firmly against the hollow post corners C thereby firmly anchoring the hollow post P thereto.

The hollow post anchoring device 1 of this invention will anchor hollow posts P of divergent construction to a supportive base B such as wood, concrete, metal, or otherwise grounded bases or structures. The device is particularly effective for anchoring hollow posts of a somewhat flexible structure such as metals and plastics and particularly hollow vinyl posts.

As well be visualized from FIGS. 1 and 4–6, the tightening nut 15N may be recessed several feet within the internal cavity H of hollow posts P to be anchored with the hollow post anchoring device 1 of this invention. A socket extension fitted with nut socket of sufficient length so as to reach into the internal confines of post chamber H to the recessed nut 15N site connected to common ratchet or power tool may be utilized to tighten nut 15N and bolt threads 15B.

What is claimed is:

1. A hollow post anchoring device for anchoring a hollow post having internal walls defining an internally disposed chamber to a supportive base, said anchoring device comprising a mounting plate for mounting the anchoring device to the supportive base, a plurality of vertical legs anchored onto said mounting plate and extending vertically upwardly therefrom so as to interface onto the internally disposed chamber of said hollow post, with said legs respectively having an inwardly projecting indentation, a biasing plate for engaging onto the inwardly projecting indentation of said legs and a biasing member for drawing said biasing plate onto said inwardly projecting indentations so as to cause each of said legs about said inwardly projecting indentation to firmly bias against said internal walls and thereby firmly anchor said hollow post to said supportive base with the anchoring device.

2. The hollow post anchoring device according to claim 1 wherein each of said legs include an upper inwardly extending knee and a lower inwardly extending knee in corresponding vertical alignment with one another and the hollow post anchoring device further includes a lower biasing plate for engagement beneath the lower extending knee of each of said legs, and an upper biasing plate for engagement above the upper extending knee of each leg, and the biasing member is operatively connected to the upper biasing plate onto the lower biasing plate for drawing together so as to outwardly force and firmly bias the upper inwardly extending knee and the lower inwardly extending knee of each of said legs against the internal walls of said hollow post.

3. The hollow post anchoring device according to claim 2 wherein the legs of said device are of a number and spacial arrangement so as to interface onto internal corners of a hollow post of a polygonal configuration.

4. The device according to claim 1 wherein the device includes four upwardly extending legs positioned so as to mate onto the internal corners of a rectangular shaped hollow post.

5. The device according to claim 2 wherein the device includes four upwardly extending legs positioned so as to mate onto the internal corners of a rectangular shaped hollow post.

6. A hollow post anchoring device for anchoring a hollow post having internal walls defining a hollow internal chamber to a supportive base, said anchoring device comprising a mounting plate for mounting the post anchoring device to the supportive base, upwardly extending legs positionally configured and supported by said mounting plate so as to interfacially engage onto the internal walls of said hollow internal chamber with each of said legs having an upper indented section laterally disposed so as to vertically mate onto a corresponding upper indented surface of an adjacently positioned leg and a lower indented section positioned beneath the upper indented section and correspondingly aligned so as to laterally mate onto a corresponding lower indented section of the adjacently positioned leg, an upper biasing plate for slidably engaging onto the upper indented section of each of said legs, a lower biasing plate for slidably engaging onto the lower indented surface of each of said legs, and a biasing member for slidably drawing together said upper biasing plate and said lower biasing plate onto said upper indented section and said lower cammed section of each of said legs and thereby causing the legs to move outwardly and firmly bias onto the internal walls and permit the hollow post to thereby be firmly anchored to said supportive base with said post anchoring device.

7. The post anchoring device of claim 6 wherein the biasing member comprises a threaded bolt fitted with a tightening nut for drawing the upper biasing plate and the lower biasing plate together.

8. The hollow post anchoring device according to claim 7 wherein the legs of said device are of a number and spacial arrangement so as to interface onto internal corners of a hollow post of a polygonal configuration.

9. The device according to claim 6 wherein the device includes four upwardly extending legs positioned so as to mate onto the internal corners of a rectangular shaped hollow post.

10. A method for anchoring a hollow post having internally disposed walls defining an internally disposed chamber to a supportive base with a post anchoring device comprised of a mounting plate for mounting the post anchoring device to the supportive base, a plurality of vertical legs anchored onto said mounting plate and extending vertically upwardly therefrom so as to interface onto an internally disposed chamber of said hollow post, with said legs respectively having an inwardly projecting indentation, a biasing plate for engaging onto the inwardly projecting indentation of said legs and a biasing member for drawing said biasing plate onto said inwardly projecting indentation so as to cause each of said legs to firmly bias against said internal walls and thereby firmly anchor said hollow post to said supportive base with the post anchoring device, said method comprising:

a) mounting the post anchoring device by securing the mounting plate to the supportive base;

b) placing a hollow post having a hollow chamber of a configuration so as to interfacially mate onto the vertical legs; and c) drawing the biasing plate onto the inwardly projecting indentation of each of said legs so as to bias the legs outwardly to said walls and thereby firmly anchor said hollow post onto the supportive base with the anchoring device.

11. The method according to claim 10 wherein the biasing member comprises a threaded bolt equipped with a threaded nut for drawing the biasing plate onto the inwardly projecting indentation of each leg and the method includes threading the nut onto said bolt so as to bias the biasing plate onto said indentations and firmly wedge said legs against the internal walls of said hollow post.

12. The method according to claim 11 wherein the hollow post comprises a hollow post of a polygonal configuration having a plurality of internal corners and the method includes placing the legs of said hollow post anchoring device in an interfacing relationship with said corners.

13. The method according to claim 11 wherein each of said legs include an upper indentation and a lower indentation aligned in a lateral relationship, the device includes an upper biasing plate positioned above the upper knee of each leg and a lower biasing plate disposed below the lower indentation of each leg and the nut when threaded onto the threaded bolt draws the upper biasing plate and lower biasing plate together, said method comprising drawing the upper biasing plate and the lower plate together by threading said nut onto said bolt.

14. The method according to claim 12 wherein the method comprises placing the corners of a rectangular post in an interfacing relationship to the legs of a hollow post anchoring device equipped with four interfacing legs.

* * * * *